US008393033B2

(12) United States Patent
Pichon et al.

(10) Patent No.: US 8,393,033 B2
(45) Date of Patent: Mar. 12, 2013

(54) APPARATUS FOR CLEANING A SUBMERGED SURFACE AND HAVING A PUMPING ENGINE OUTSIDE THE HYDRAULIC SYSTEM

(75) Inventors: Philippe Pichon, Villeneuve de Riviere (FR); Emmanuel Mastio, Fourquevaux (FR)

(73) Assignee: Zodiac Pool Care Europe, Paris (FR)

( * ) Notice: Subject to any disclaimer, the term of this patent is extended or adjusted under 35 U.S.C. 154(b) by 200 days.

(21) Appl. No.: 12/808,683

(22) PCT Filed: Dec. 18, 2008

(86) PCT No.: PCT/FR2008/052372

§ 371 (c)(1),
(2), (4) Date: Sep. 20, 2010

(87) PCT Pub. No.: WO2009/081062

PCT Pub. Date: Jul. 2, 2009

(65) Prior Publication Data

US 2011/0000034 A1 Jan. 6, 2011

(30) Foreign Application Priority Data

Dec. 21, 2007 (FR) ..... 07 08999

(51) Int. Cl.
*E04H 4/16* (2006.01)

(52) U.S. Cl. ..... 15/1.7; 210/167.16; 210/232

(58) Field of Classification Search ..... 15/1.7; 210/167.1, 167.16, 167.17, 416.2, 459; 4/490, 4/496; 134/110, 109, 167 R, 168 R
See application file for complete search history.

(56) References Cited

U.S. PATENT DOCUMENTS 4,768,532 A * 9/1988 Johnson ..... 134/111
5,842,243 A * 12/1998 Horvath et al. ..... 15/1.7
6,013,178 A 1/2000 Strano et al.

(Continued)

FOREIGN PATENT DOCUMENTS

EP 0989255 3/2000
FR 2567552 1/1986

(Continued)

OTHER PUBLICATIONS

International Search Report in Application No. PCT/FR2008/052372.

*Primary Examiner* — Monica Carter
*Assistant Examiner* — Andrew A Horton
(74) *Attorney, Agent, or Firm* — Dean W. Russell; Kilpatrick Townsend & Stockton LLP

(57) ABSTRACT

Detailed is a device for cleaning an immersed surface including a body; members for driving the body; a filtration chamber which has: a liquid inlet and a liquid outlet; a filtering device which is removably mounted in the filtration chamber; a hydraulic circuit for the flow of liquid between the inlet and the outlet through the filtering device; an axial pumping propeller which is interposed in the hydraulic circuit; a flap for access to the filtering device, wherein the pumping propeller is orientated in order to generate a liquid flow with a horizontal component towards the rear, the outlet being opposite the propeller; the pumping motor is arranged below the hydraulic circuit; the access flap is arranged at the top and/or towards the front of the hydraulic circuit in order to allow the filtering device to be disassembled via the top and/or towards the front.

7 Claims, 8 Drawing Sheets

U.S. PATENT DOCUMENTS

Figure 1:
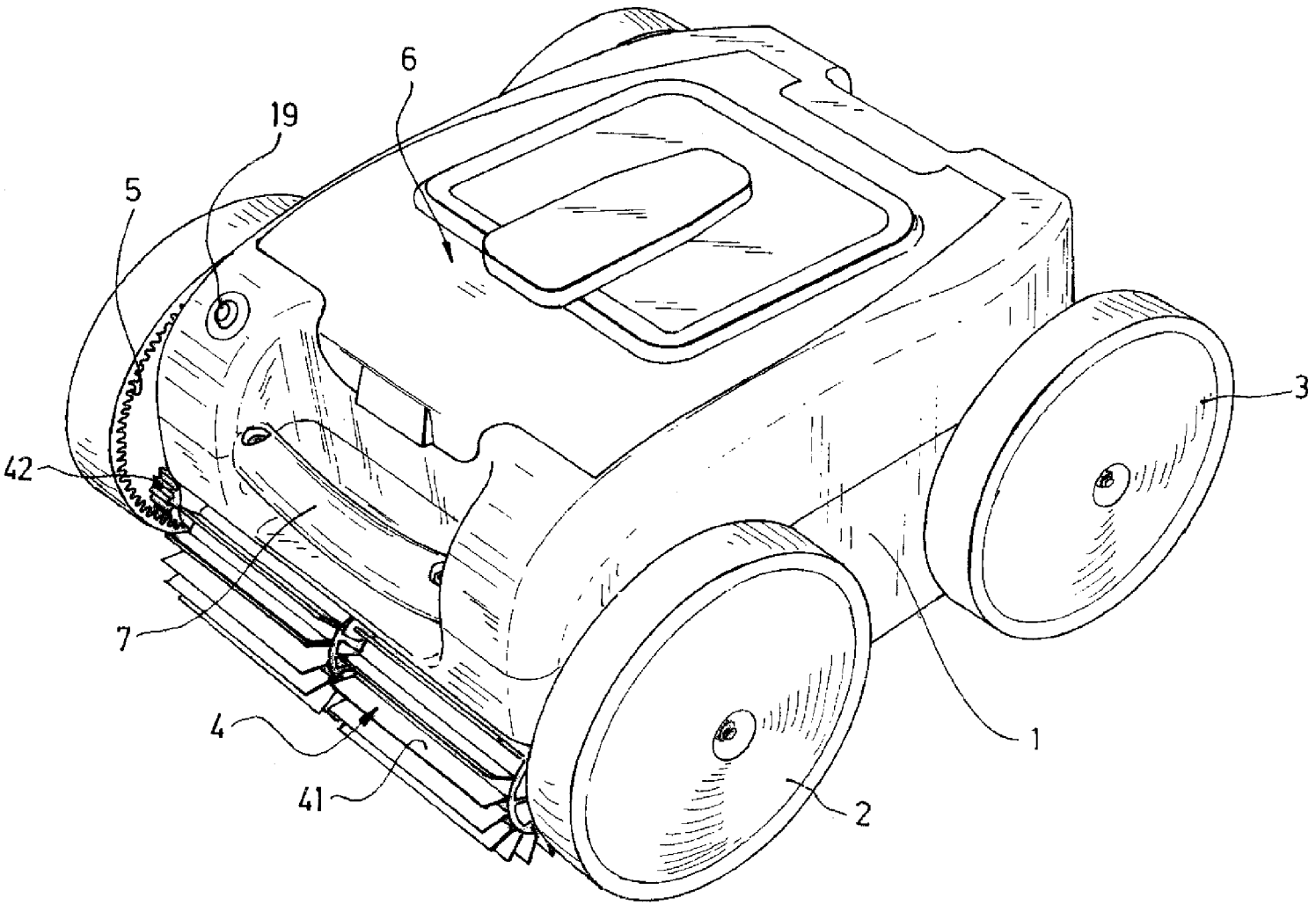

| | | | | |
|---|---|---|---|---|
| 6,409,916 | B1 | 6/2002 | Zelas et al. | |
| 6,473,927 | B1 * | 11/2002 | Sommer | 15/1.7 |
| 6,627,074 | B2 * | 9/2003 | Lincke | 210/167.17 |
| 6,886,205 | B1 * | 5/2005 | Pichon | 15/1.7 |
| 2001/0032809 | A1 * | 10/2001 | Henkin et al. | 210/143 |
| 2002/0104790 | A1 | 8/2002 | Lincke | |
| 2007/0157413 | A1 | 7/2007 | Roumagnac | |
| 2007/0251032 | A1 * | 11/2007 | Pichon et al. | 15/1.7 |

FOREIGN PATENT DOCUMENTS

| | | |
|---|---|---|
| FR | 2896005 | 7/2007 |
| WO | WO8700883 | 2/1987 |
| WO | WO0250388 | 6/2002 |
| WO | WO02092189 | 11/2002 |

* cited by examiner

APPARATUS FOR CLEANING A SUBMERGED SURFACE AND HAVING A PUMPING ENGINE OUTSIDE THE HYDRAULIC SYSTEM

CROSS REFERENCE TO RELATED APPLICATIONS

This application is the U.S. national phase of International Application No. PCT/FR2008/052372 filed on Dec. 18, 2008 and published on Jul. 2, 2009 as International Publication No. WO 2009/081062 A2, which application claims priority to French Patent Application No. 0708999 filed on Dec. 21, 2007, the entire contents of both of which are incorporated herein by reference.

The invention relates to a device for cleaning a surface which is immersed in a liquid, in particular a swimming pool surface.

A number of known swimming pool cleaning devices comprise:

- a hollow body and members for driving the body over the immersed surface in a main direction of advance, called the longitudinal direction,
- a filtration chamber which is provided in the body and which has:
- at least one liquid inlet into the hollow body, located at the base and at the front of the body,
- at least one liquid outlet out of the hollow body, located remotely from the base of the body,
- a hydraulic circuit which is capable of providing a flow of liquid between each inlet and each outlet through a filtering device which is removably mounted in the filtration chamber,
- an electric pumping motor which has a rotating drive shaft which is directly coupled to at least one axial pumping propeller which is interposed in the hydraulic circuit in order to generate therein a flow of liquid in the axial direction of the propeller, and between each inlet and each outlet,
- a flap for access to the filtering device, which is provided on an outer wall of the hollow body and which is capable of allowing the filtering device to be disassembled and removed from the hollow body in order for it to be cleaned.

In these known devices (cf., for example, FR 2 567 552, WO 0 250 388, . . . ), the pumping motor is arranged vertically, generally at the center of the hollow body, and the hydraulic circuit extends at one side and the other of the pumping motor. This arrangement is considered to promote the efficiency of the pump by minimizing the pressure losses and optimizing the flow and the filtration.

The inventors have now established that this arrangement is extremely unfavorable with respect to the performance levels of the device. It is relatively large in the vertical direction which involves in particular a higher level of hydraulic resistance to forward movement, and therefore higher energy consumption, a greater weight and size and therefore finally, with equivalent performance levels, a high cost.

Furthermore, it requires the flap for access to the filtration device to be located at the base of the hollow body, the liquid inlets being necessarily provided with non-return devices, such as valves; or a particularly complex path for the hydraulic circuit if the access flap is arranged above the device (cf., for example, U.S. Pat. No. 6,409,916).

In this context, therefore, an object of the invention is to provide, for cleaning an immersed surface, a device whose cost/performance ratio is greatly improved compared with that of prior devices. More specifically, an object of the invention is to provide such a device whose cost can be substantially reduced with performance levels which are equivalent to or even greater than those of known devices.

An object of the invention is also to provide a device of the type whose filtering device can be readily disassembled in order to allow it to be cleaned whilst at the same time having high hydraulic (flow, suction) and filtration performance levels.

To this end, the invention relates to a device for cleaning an immersed surface comprising:

- a hollow body and members for driving the body over the immersed surface in a main direction of advance, called the longitudinal direction,
- a filtration chamber which is provided in the body and which has:
- at least one liquid inlet into the hollow body located at the base and at the front of the body,
- at least one liquid outlet out of the hollow body, located remotely from the base of the hollow body,
- a filtering device which is removably mounted in the filtration chamber in order to allow the filtering device to be disassembled and removed from the hollow body,
- a hydraulic circuit which is capable of providing a flow of liquid between each inlet and each outlet through the filtering device,
- an electric pumping motor which has a rotating drive shaft which is directly coupled to at least one axial pumping propeller which is interposed in the hydraulic circuit in order to generate therein a flow of liquid in the axial direction of the propeller, and between each inlet and each outlet,
- a flap for access to the filtering device, which is provided on an outer wall of the hollow body and which is capable of allowing the filtering device to be disassembled and to pass through this access flap, wherein:

- each pumping propeller is axially orientated so as to generate a flow of liquid having a horizontal component towards the rear, at least one liquid outlet directly facing the pumping propeller, so that said liquid flows out of said liquid outlet in a direction which corresponds to that of said flow of liquid generated by said pumping propeller,
- said pumping motor is located below said hydraulic circuit, entirely at the outer side of said hydraulic circuit, said hydraulic circuit completely bypassing said pumping motor at the top, said rotating shaft of said pumping motor extending through a lower wall, said lower wall delimiting said hydraulic circuit and comprising a sealing assembly for said rotating shaft,
- said access flap is located at the top and/or towards the front of said hydraulic circuit, and is adapted to allow a disassembling of said filtering device and its moving out of the hollow body in a top and/or front direction.

The inventors have found that this specific arrangement in practice at the same time allows the hydraulic (flow, suction, . . . ) and filtering performance levels of the device to be maintained, in particular with an axial pumping propeller whilst substantially reducing the vertical spatial requirement and therefore the hydraulic drag thereof, and recovering directly, with no pressure loss, at least part of the residual hydraulic energy in the discharge flow in order to contribute to driving the device.

Consequently, with equivalent suction and cleaning performance levels, a device according to the invention may be provided with a driving device which has a much lower power and which therefore involves lower consumption and costs. Consequently, the device is also generally smaller and lighter which, in addition to the savings made, is a significant advantage for the user, in particular in terms of handling, transport and storage of the device.

Furthermore, the architecture of a device according to the invention allows the filtering device to be arranged at the top and/or towards the front of the device so that the filtering device of a device according to the invention can be disassembled from the front and/or the top of the device. Such a disassembly does not involve complex operations for handling the device. In particular, it is not necessary to invert the device in order to remove the filtering device in order to clean it. Disassembling the filtering device can be carried out when the device is in the rest position, in its normal position, on a horizontal surface.

Furthermore, such architecture facilitates access to the motor and allows the motor to be disassembled via the bottom of the device, if necessary.

According to the invention, each pumping propeller which is capable of generating a flow of liquid in the hydraulic circuit is rotated by means of a pumping motor which is arranged below the hydraulic circuit and which comprises a rotating drive shaft which extends through a lower wall which delimits the hydraulic circuit.

Since each pumping propeller is orientated axially in order to generate a flow of liquid with a horizontal component towards the rear, this propeller has an inclination with the longitudinal direction of between 0° and 90° (values excluded).

Advantageously and according to the invention, the pumping motor has a rotating drive shaft which is coaxial with the rotation axis of the pumping propeller. The rotating drive shaft for driving the pumping propeller may be inclined in any manner relative to the rotation axis of the pumping propeller. However, advantageously and according to the invention, the pumping motor has an inclined rotating drive shaft which forms, with the longitudinal direction, an angle which is not zero and which is different from 90°.

In this manner, according to this variant of the invention in which the drive shaft is parallel with the axis of the pumping propeller, the coupling between the motor and the propeller may be a simple direct coupling. Furthermore, according to this variant, the device has a minimal vertical spatial requirement, which reduces the hydraulic drag of the device.

Advantageously and according to the invention, the pumping propeller has an inclined rotation axis which forms, with the longitudinal direction, an angle which is not zero and which is different from 90°—in particular between 30° and 60°—and which is capable of generating a flow of liquid which is orientated in accordance with this axis towards the liquid outlet in the direction away from the base of the hollow body. Advantageously and according to the invention, each liquid outlet is offset, in the longitudinal direction, from each liquid inlet with which it is in communication via the hydraulic circuit, and the rotation axis of each axial pumping propeller interposed in the hydraulic circuit is parallel with the inclined middle direction which extends through each liquid inlet and each liquid outlet connected by this hydraulic circuit.

The inventors have established that such an inclination is a good compromise which at the same time allows good suction of debris, with no detrimental pressure losses, a rear pressure via the discharge jet which has a vertical component which is sufficient to contribute to the movement of the device over the immersed surface, a substantial reduction of the vertical spatial requirement of the device and a significant reduction of the hydraulic drag of the device which allows a low-power electric drive motor to be used.

The filtering device of a device according to the invention may be of any type.

Advantageously and according to the invention, the filtering device comprises at least one rigid filtering cartridge.

This cartridge may be of any type. According to one embodiment of the invention, this cartridge is mounted in the filtration chamber in the manner of a drawer. To this end, this cartridge comprises lateral ribs which are capable of co-operating with grooves which are provided in the hollow body and which are capable of guiding the cartridge in the hollow body. The removal of the filtering device is the result of a translation movement of the filtering device along the grooves of the hollow body. Such a filtering device can readily be inserted into the hollow body by positioning the ribs of the device opposite the grooves of the hollow body, then by sliding the filtering device into the hollow body.

According to the invention, a filtering device is removably mounted in the filtration chamber in order to allow the filtering device to be disassembled and removed from the hollow body in order for it to be cleaned or replaced. Furthermore, the device according to the invention comprises an access flap which is capable of allowing the filtering device to be readily disassembled and removed from the hollow body in order for it to be cleaned or replaced.

According to an embodiment of the invention, the access flap is provided on the upper portion of the device.

According to another embodiment, the access flap is provided at least partially towards the front of the device.

The access flap may be of any type. It may in particular be provided with a cover which is entirely removable in order to leave a space for the removal of the filtering device.

According to an advantageous variant of the invention, the access flap comprises a cover which is articulated to the body of the device.

According to this variant, a user can readily pivot the articulated cover about the articulation thereof in order to reveal an opening through which the filtering device can be removed in order for it to be cleaned or replaced.

According to another advantageous variant of the invention, the filtering device has an upper wall which forms the cover of the access flap so that a user can directly grip the filtering device and remove it from the device.

According to this variant, the cover of the flap forms a wall of the filtering device so that a user can directly, without opening a cover beforehand, grip the filtering device and remove it from the device in order to clean or replace it.

Preferably, a device according to the invention has a single liquid inlet located at the base and at the front of the body of the device and a single liquid outlet located at the rear of the hollow body opposite the pumping propeller so that liquid flows out of the device via this outlet in a direction which corresponds to that of the liquid flow generated by the pumping propeller.

Advantageously and according to the invention, the rotation axis of at least one pumping propeller is parallel with the inclined middle direction which extends through the liquid inlet and the liquid outlet. Furthermore, advantageously and according to the invention, at least one liquid outlet out of the hollow body is substantially coaxial, to within 5°, with the rotation axis of the axial pumping propeller.

Advantageously and according to the invention, the members for driving the body over the immersed surface comprise at least one electric drive motor, each electric motor being arranged below the hydraulic circuit.

Preferably, the electric motor for driving the device over the immersed surface and the pumping motor are arranged in the same sealed chamber below the hydraulic circuit. Access to them is thus facilitated, for example, via a single removable lower wall if a maintenance operation has to be carried out.

The invention further relates to a device for cleaning an immersed surface, characterized in combination by all or some of the features mentioned above or below.

Figure 2:
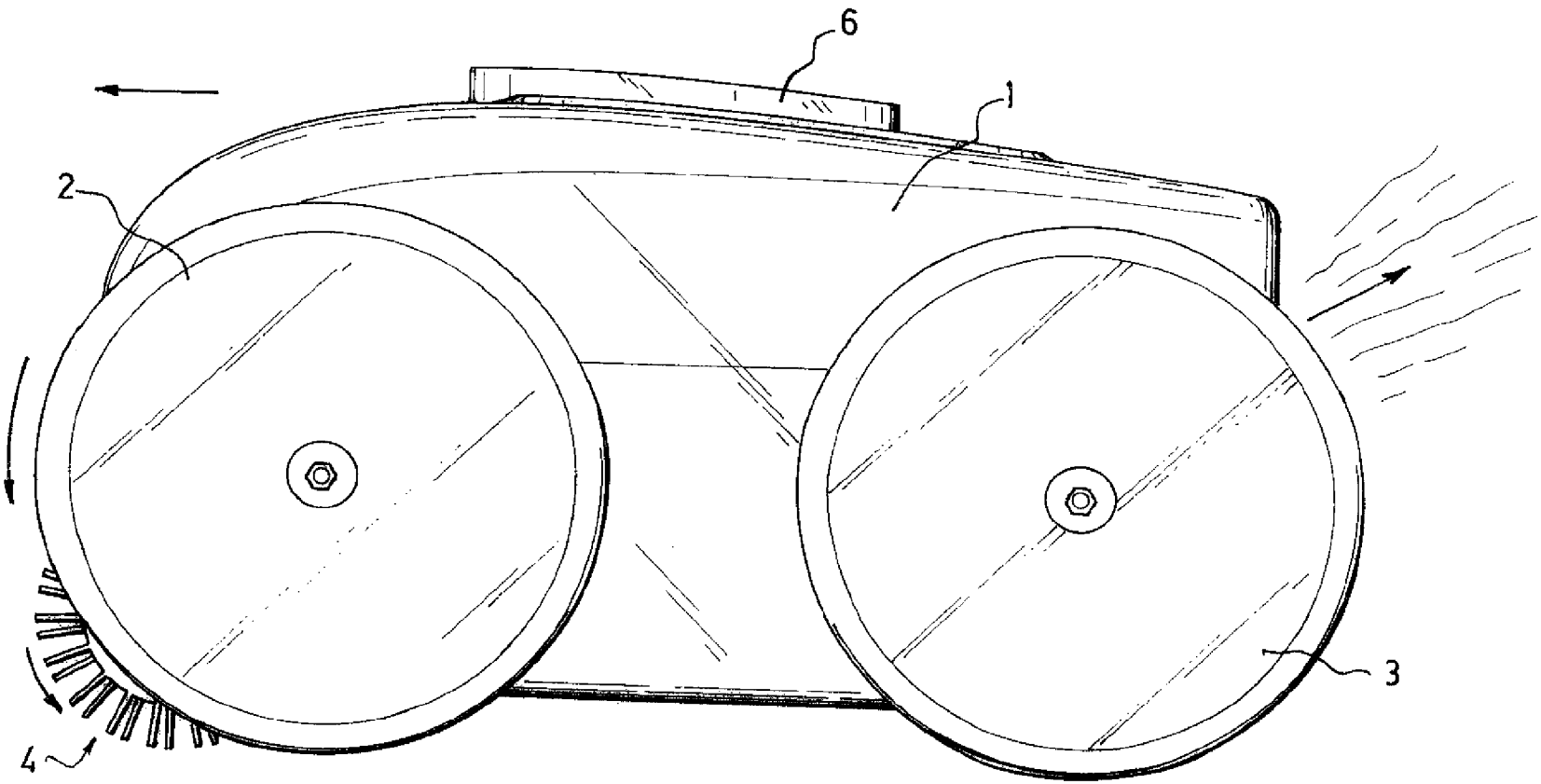
Figure 3:
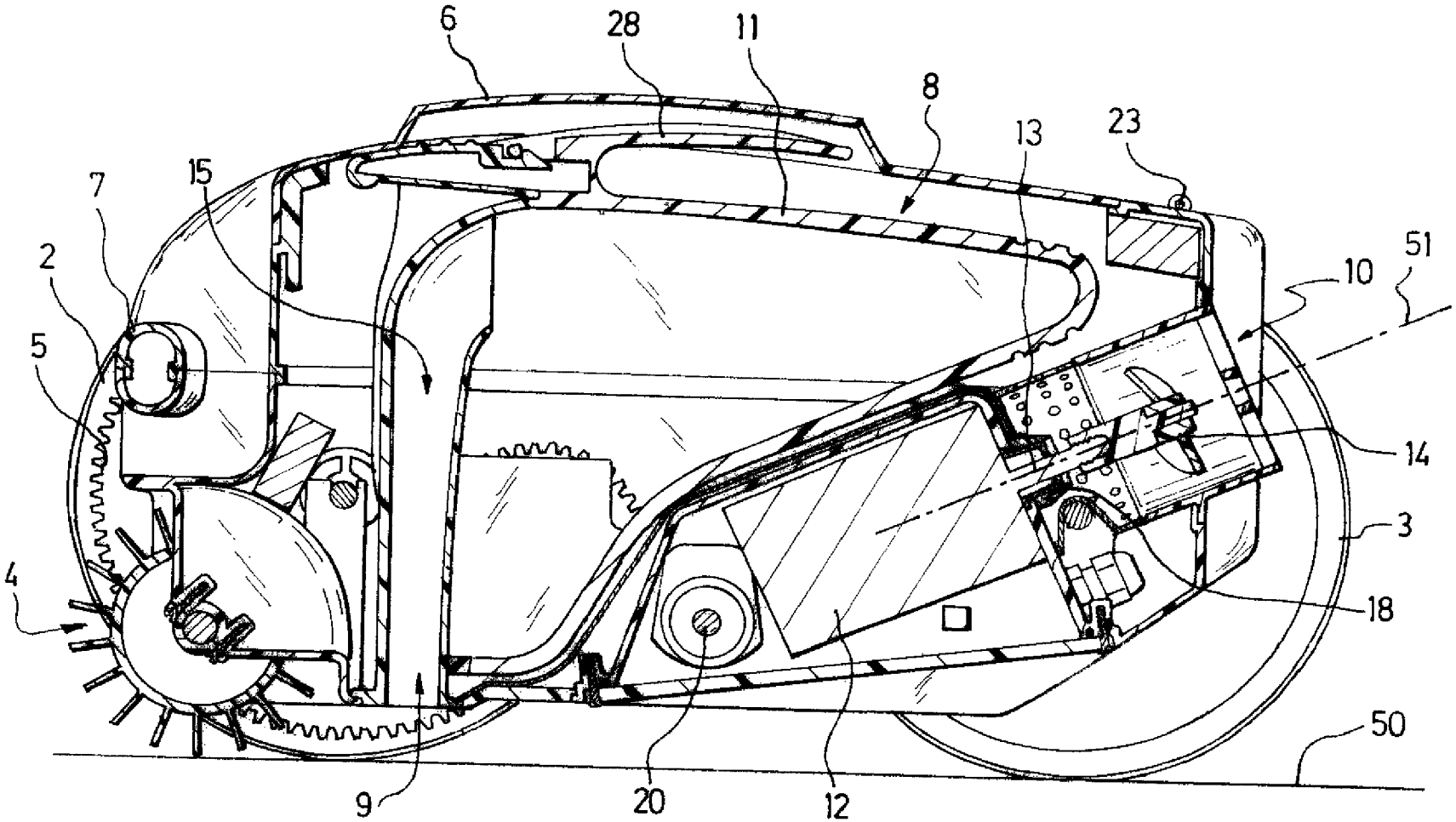
Figure 4:
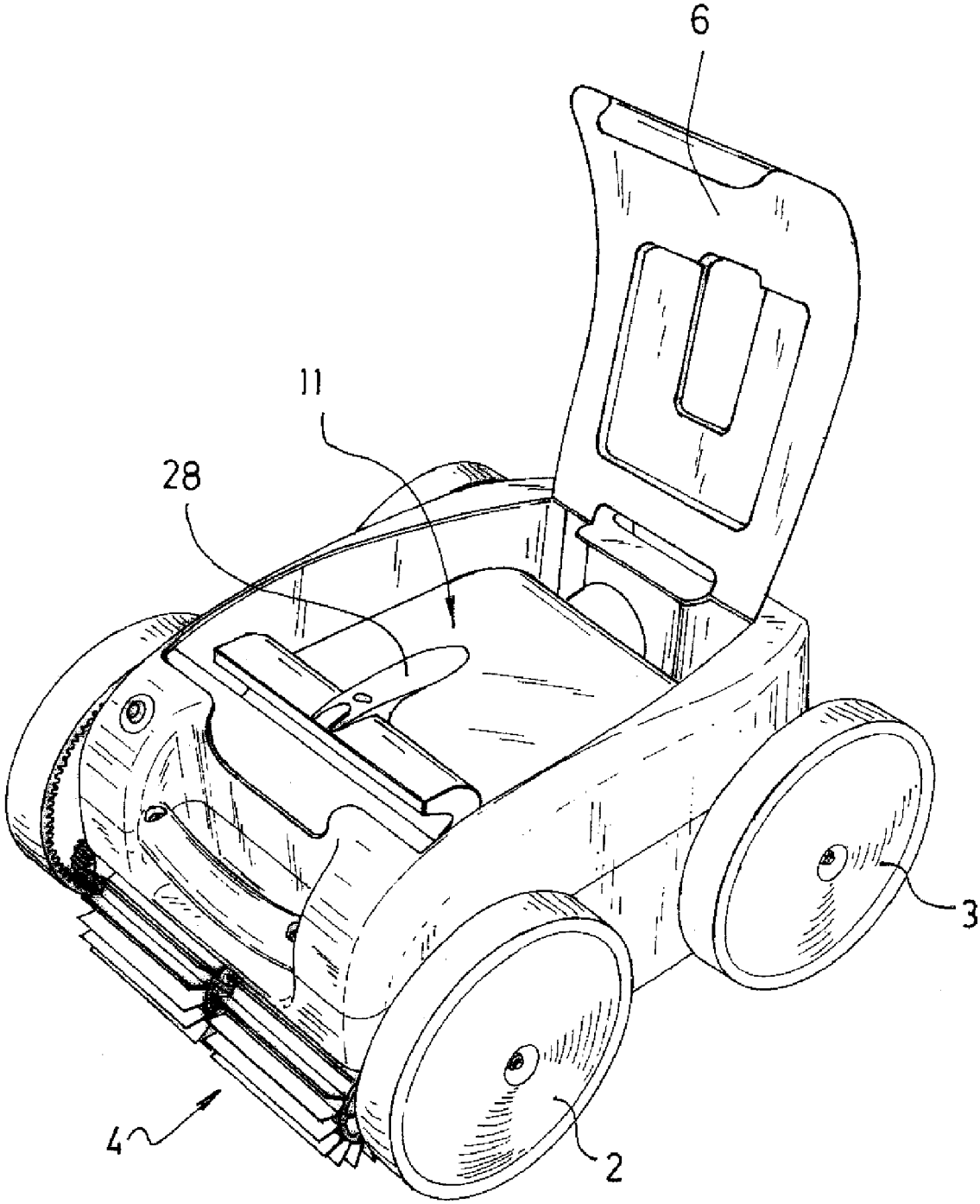
Figure 5:
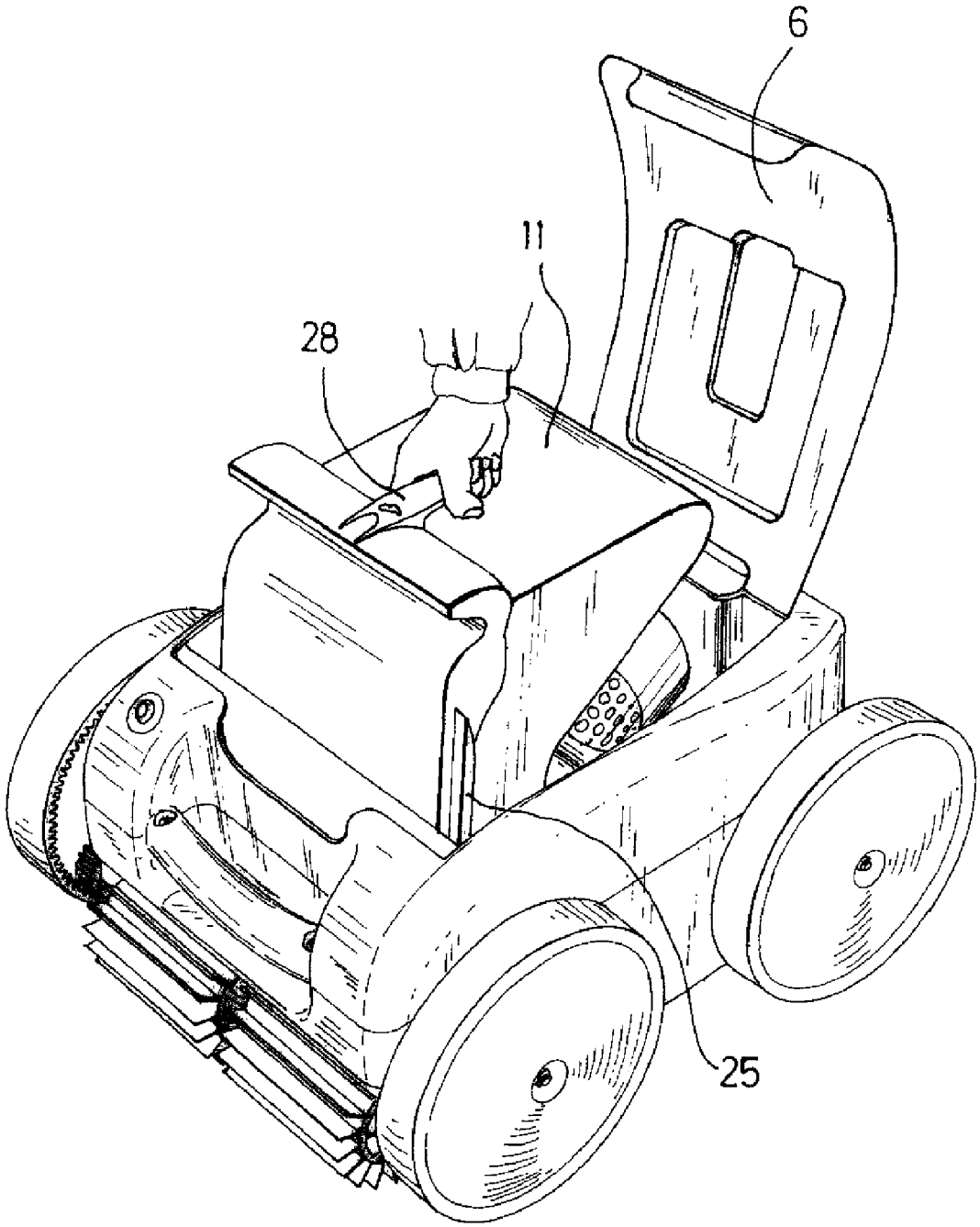
Figure 6:
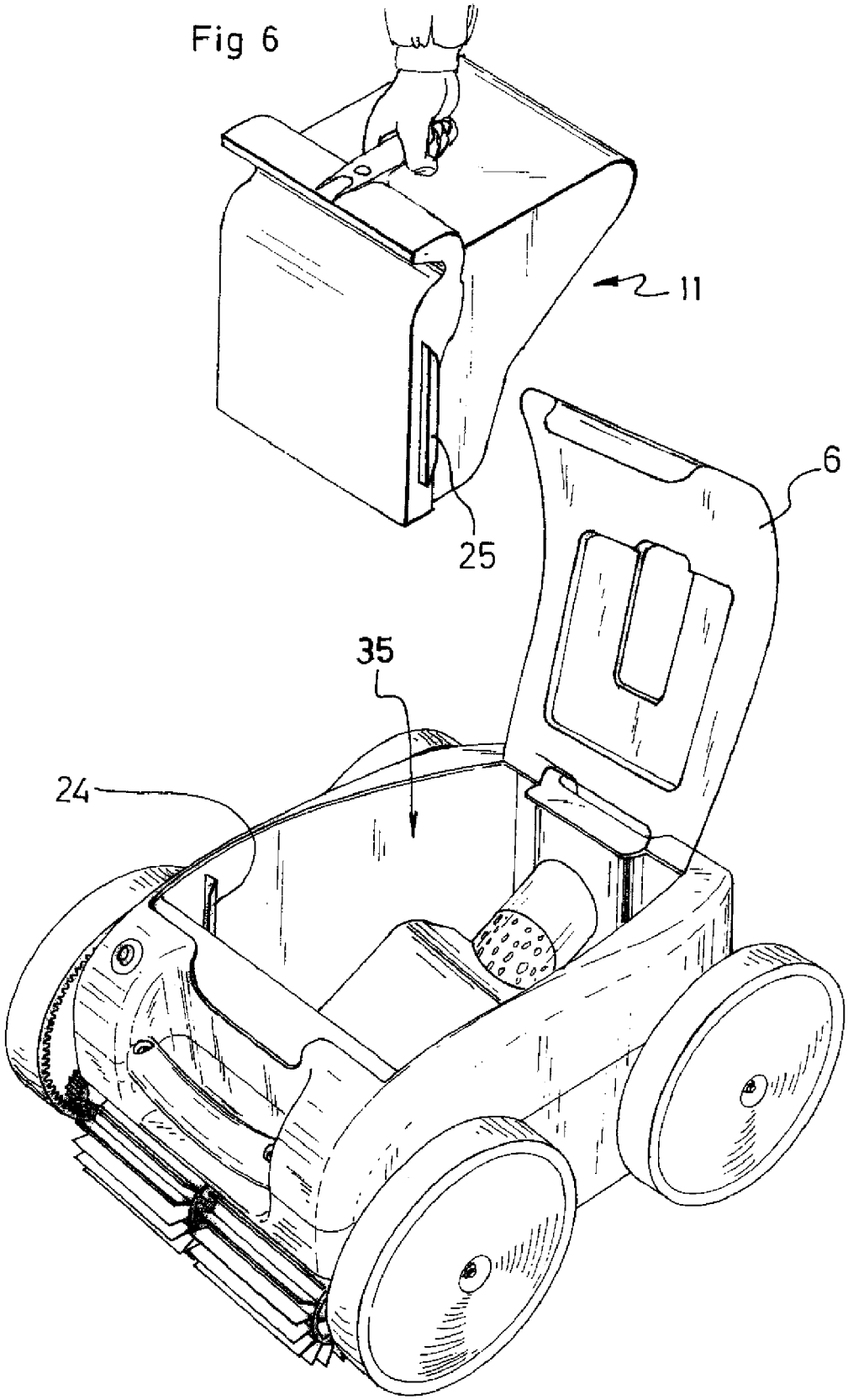
Figure 7:
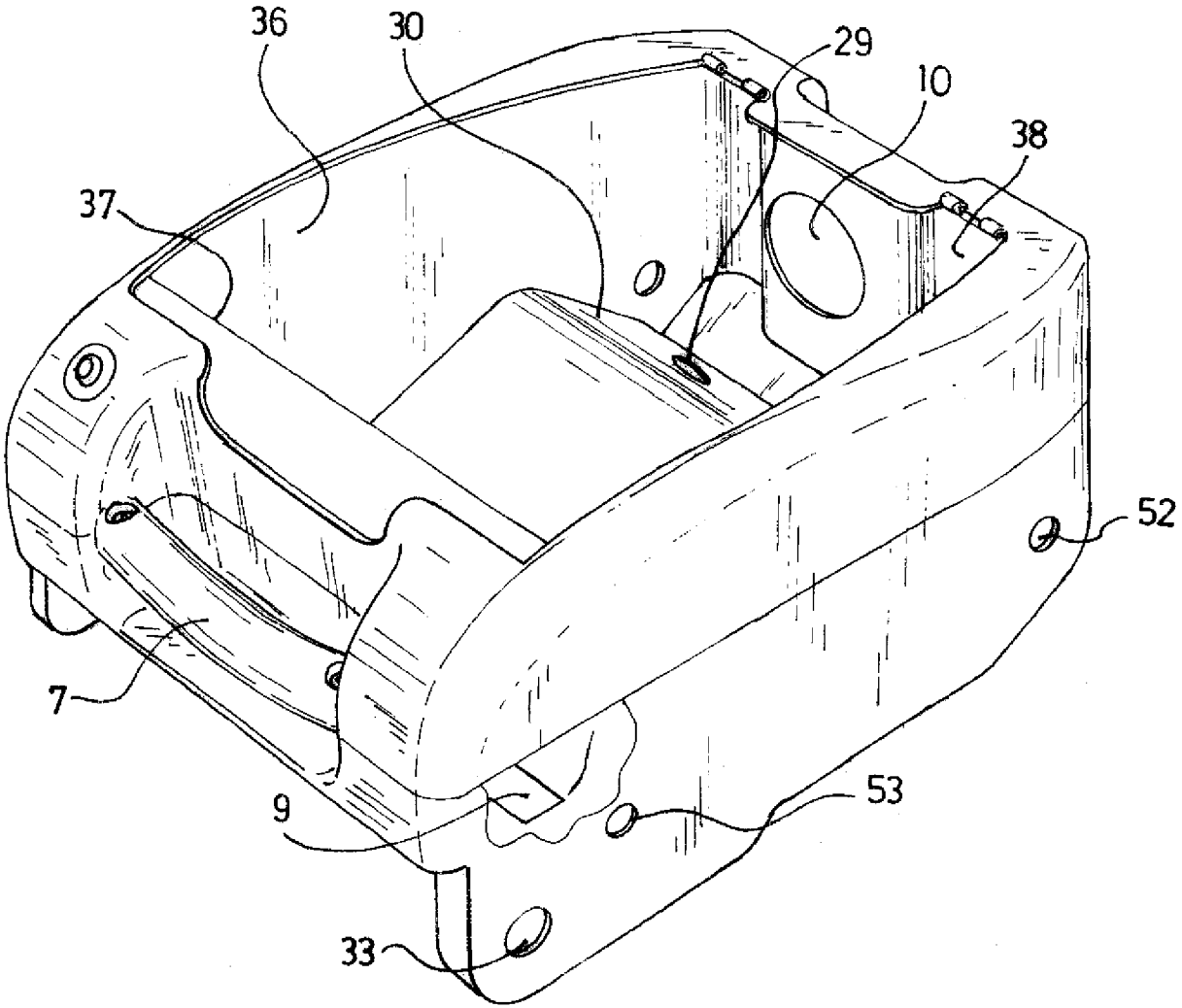
Figure 8:
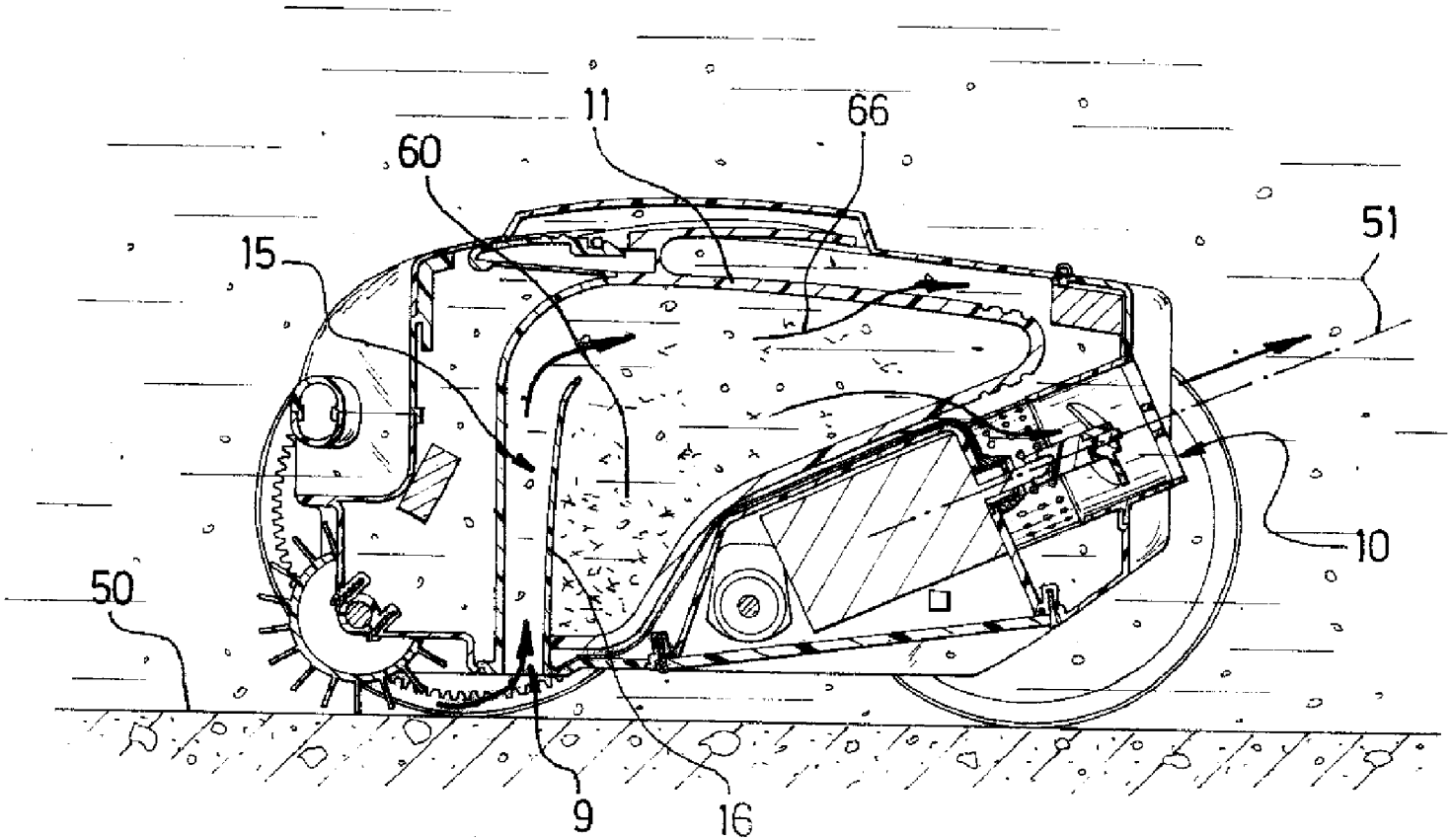

Other features, objectives and advantages of the invention will be appreciated from a reading of the following description, which sets out, by way of non-limiting example, an embodiment of the invention with reference to the appended drawings, in which:

FIG. 1 is a schematic perspective view of a cleaning device according to an embodiment of the invention, FIG. 2 is a schematic side view of a cleaning device according to an embodiment of the invention, FIG. 3 is a schematic section of a cleaning device according to an embodiment of the invention, FIG. 4 is a schematic perspective view of a cleaning device according to an embodiment of the invention whose flap for access to the filtering device is open in order to allow the filtering device to be removed, FIG. 5 is a schematic perspective view of a cleaning device according to an embodiment whose filtering device is being removed from the device, FIG. 6 is a schematic perspective view of a cleaning device according to an embodiment whose filtering device has been removed from the device, FIG. 7 is a schematic view of a housing of a cleaning device according to an embodiment of the invention, FIG. 8 is a simplified schematic section of FIG. 3 illustrating the device during operation over an immersed surface.

In the Figures, the scales and proportions are not strictly complied with for the purposes of illustration and clarity.

In all of the following detailed description with reference to the Figures, unless indicated otherwise, each component of the cleaning device is described as it is arranged when the device is moving normally over a horizontal immersed surface in a preferred direction of advance, relative to which the front and the rear of the device are defined.

A device according to the invention comprises a hollow body 1 and rolling members 2, 3, 4 for guiding and driving the hollow body 1 over an immersed surface in at least one preferred direction of advance and in a main direction of advance, called the longitudinal direction, parallel with the immersed surface.

This hollow body 1 is formed principally by a concave housing which delimits a main chamber. This concave housing is, for example, produced by means of molding or rotational molding. This housing is preferably produced from a thermoplastic material, such as polyethylene, polypropylene, ABS, PMMA or any equivalent material.

This hollow body 1 has a central chamber 35 which is capable of receiving a filtration chamber. This central chamber 35 is delimited by a lower wall which extends in a substantially horizontal plane; by lateral walls 36 which generally extend in vertical planes; by a front wall 37 which generally extends in a vertical plane, orthogonal relative to the planes of the vertical lateral walls 36; and by a rear wall 38 which generally extends in a vertical plane orthogonal relative to the planes of the vertical lateral walls 36.

The lower wall has an opening which extends transversely in the region of the front wall 37 so that liquid is able to enter the central chamber 35 via this lower transverse opening. This opening forms a liquid inlet 9 in the hollow body 1 located at the base of the hollow body.

The rear wall 38 comprises a cylindrical opening which forms a liquid outlet 10 out of the hollow body 1. This liquid outlet 10 which is provided in the rear wall 38 of the housing is located remote from and opposite the base of the hollow body and is longitudinally offset from the liquid inlet 9 which is provided in the lower wall. Furthermore, this liquid outlet 10 is provided in the upper portion of the housing in such a manner that it is also vertically offset from the liquid inlet 9.

This central chamber 35, this liquid inlet 9 and this liquid outlet 10 form a filtration chamber 8. This filtration chamber 8 further comprises a hydraulic circuit which is capable of providing a flow of liquid between the liquid inlet 9 and the liquid outlet 10 through a filtering device 11.

Preferably, the liquid inlet 9 and liquid outlet 10 are centered on the same longitudinal vertical center plane of the device.

The central chamber 35 of the hollow body 1 is capable of receiving a filtering device 11. The filtering device 11 is arranged between the liquid inlet 9 and the liquid outlet 10.

This filtering device 11 may be of any known type.

For example, the filtering device 11 comprises a rigid frame 26 and a filtering sheet—in particular a filtering material 27—carried by this rigid frame 26. Such a filtering device 11 is therefore self-supporting and can be readily handled by a user.

The device also comprises a flap 6 for access to this filtering device. This access flap 6 forms an upper wall of the hollow body 1 and covers it. In the embodiment illustrated, this flap 6 is provided on the upper portion of the device so that a person using the device can readily open the flap 6 and remove the filtering device 11. Preferably, the access flap 6 is articulated to the body 1 of the device by means of hinges 23 which are provided at the rear of the device.

Preferably, the filtering device 11 is a device which is mounted in the central chamber 35 of the hollow body 1 in the manner of a drawer. To this end, the rigid frame 26 of the filtering device 11 has two ribs 25 which extend laterally at each side of the filtering device 11. These ribs 25 have shapes and dimensions which correspond to and complement the shapes and dimensions of grooves 24 which are fixedly joined to the hollow body 1. These grooves 24 which are fixedly joined to the hollow body 1 extend vertically along the inner faces of the vertical lateral walls of the hollow body 1. The ribs 25 of the filtering device 11 are therefore capable of co-operating with the grooves 24 of the hollow body 1 of the device.

In this manner, the removal of the filtering device 11 is the result of a translation movement of the filtering device 11 along the grooves 24 of the hollow body 1. A user can therefore readily remove the filtering device 11 from the hollow body 1 in order, for example, to clean it. After the filtering device 11 has been cleaned, a user can readily reintroduce the filtering device 11 into the hollow body 1 by orientating the filtering device 11 so that the ribs 25 of the filtering device 11 are opposite the grooves 24 of the hollow body, then by sliding the filtering device 11 in the hollow body 1.

The filtering device 11 further comprises a handle 28 which is provided on an upper portion of the filtering device 11 in order to facilitate handling of the filtering device 11. In particular, a user is able to readily assemble/disassemble the filtering device 11 using this handle 28 when the device is taken out of the liquid and is resting on a horizontal surface.

According to the invention, a device comprises a motorized liquid pumping device which comprises an electric pumping motor 12 which has a rotating drive shaft 13 which is coupled to a pumping propeller 14 which is interposed in the hydraulic circuit in order to generate a liquid flow therein between the liquid inlet 9 and the liquid outlet 10. The liquid outlet 10 is directly opposite the pumping propeller so that the liquid flows out of the liquid outlet 10 in a direction which corresponds to the liquid flow generated by the pumping propeller, this flow having a speed which is orientated in accordance with the rotation axis 51 of the propeller 14.

The pumping propeller 14 has an orientation which allows a flow of liquid to be generated with a horizontal component towards the rear.

Preferably, the pumping propeller 14 which is interposed in the hydraulic circuit between the liquid inlet 9 and liquid outlet 10 has an inclined rotation axis which forms, with the longitudinal direction and with the theoretical rolling plane 50, an angle a which is not equal to 0° or 90°. This propeller 14 is rotated by means of an electric pumping motor 12 which preferably has a rotating drive shaft 13 which is parallel with the rotation axis of the propeller 14. Advantageously, there is provided a propeller fairing which surrounds the axial pumping propeller 14 over the entire height thereof (axial length).

According to the invention, the electric pumping motor 12 is arranged below the hydraulic circuit entirely at the outer side of this hydraulic circuit which completely bypasses the pumping motor 12 at the top. The rotating shaft 13 of the pumping motor 12 extends through an inclined lower wall 30 which delimits the hydraulic circuit. The sealing is provided by an O-ring 18.

FIG. 7 illustrates the hollow body 1 of the device comprising the inclined lower wall 30 in which an opening 29 is provided for passage of the rotating shaft 13 of the pumping motor 12.

FIG. 8 illustrates the flow of liquid in the hollow body 1 of the device. This flow is illustrated schematically in FIG. 8 by means of arrows 66. Liquid enters the hollow body 1 via the liquid inlet 9 which is arranged below the device. This liquid passes into a liquid inlet column 15 in order to reach the filtering device 11. This filtering device 11 allows the liquid to pass through the filtering material and retains the solid debris 60. The filtered liquid reaches the liquid outlet 10 and is discharged at the rear of the device into the pool from which it originates. The flow of liquid which flows in the region of the propeller 14 opposite the liquid outlet 10 is a clean flow of liquid filtered by the filtering device 11. Consequently, the propeller 14 is protected from coming into contact with debris 60 which prevents the propeller from becoming clogged and increases the service life and the efficiency thereof.

Since the liquid outlet 10 is opposite the pumping propeller 14, the liquid flows out of the device via this outlet with a speed V which is orientated in accordance with the axis 51 of the pumping propeller 14 and which has a longitudinal component towards the rear which brings about, by means of reaction, forces whose resultant has a longitudinal drive component which is orientated towards the front and which is involved in driving the device over the immersed surface.

The orientation of the hydraulic reaction force created by the discharge flow and therefore the size of the longitudinal component thereof are dependent on the inclination a relative to the theoretical rolling plane 50, the rotation axis 51 of the propeller and the liquid outlet 10. Preferably, this inclination a is between 15° and 45°.

According to the invention, the pumping motor is arranged below the hydraulic circuit, entirely outside this hydraulic circuit, in such a manner that the filtering device 11 of the hydraulic circuit can be removed from the device at the top of the device as mentioned above, without being impeded by the pumping motor. Only the pumping propeller 14 is arranged in the hydraulic circuit in order to be able to provide the flow of liquid. This pumping propeller 14 is arranged at the rear of the device, close to the liquid outlet 10. That is to say, the pumping propeller 14 and the liquid outlet 10 form the end portion of the hydraulic circuit.

In the preferred embodiment of the invention illustrated in the Figures, the rolling members for guiding and driving the device comprise a front axle which comprises front drive wheels 2, one at each side, and a rear axle which comprises rear non-drive wheels 3, one at each side.

Furthermore, preferably and as illustrated in the Figures, the device comprises brushes 4 which are arranged at the front of the device. These brushes 4 are intended to brush the immersed surface and move the debris which are brushed towards the rear of the device in the direction of the liquid inlet 9 which is arranged below the device.

FIG. 7 illustrates openings 52, 53 which are provided in the housing and which are capable of allowing the front and rear axles of the device which carry the front wheels 2 and rear wheels 3, respectively, to pass through. This housing also has openings 33 which are capable of allowing the drive shaft of the brushes 4 to pass through.

The device further comprises at least one electric motor 20 for driving the front drive wheels 2. Preferably, the device comprises two drive motors 20, one at each side, for independently driving each of the front wheels 2, respectively. To this end, each front wheel 2 has an internal toothed arrangement 5 which co-operates with a pinion 45 which is driven by a drive motor 20.

These brushes 4 may be of any type. According to one embodiment of the invention, the device comprises two coaxial front brushes 4. Each brush 4 is capable of being rotated about an axis which extends in a direction, which is called the transverse direction, and which is perpendicular relative to the longitudinal direction. Each brush 4 comprises a plurality of fins 41 which extend radially from a brush shaft which forms the rotation axis of the brush 4. The fins 41 are, for example, of rubber or a strong plastics material.

Furthermore, the brushes 4 are preferably also rotated by at least one electric motor 20 for driving the front wheels 2 by means of a gear system. According to this embodiment, the internal toothed arrangement 5 of each front drive wheel 2 co-operates with a pinion 42 which is fixed to one end of the shaft of a brush 4 in such a manner that a rotation of the wheel 2 brings about, by means of the toothed arrangement 5 and the pinion 42, the rotation of the shaft of the brush 4 and therefore the rotation of the brush 4.

In this manner, in the embodiment illustrated, the rolling members are constituted by the front drive wheels 2, rear non-drive wheels 3 and brushes 4 which are involved in driving and guiding the device over the immersed surface. Nonetheless, the rolling members 2, 3, 4 have zones which are intended to come into contact with the immersed surface which are coplanar and define a theoretical rolling plane 50. The longitudinal direction of advance of the device is parallel with this theoretical rolling plane 50.

The front wheels 2 preferably have a diameter of between 100 mm and 500 mm, in particular between 150 mm and 250 mm. According to the embodiment of the Figures, the front wheels 2 have a diameter in the order of 200 mm. In this manner, these front wheels 2 facilitate the passing of obstacles and have improved traction. Advantageously, their peripheral tread is formed by or covered with an anti-skid material.

The front wheels 2 and the brushes 4 constitute front drive rolling members 2, 4 which protrude forwards relative to the other constituent elements of the device, in particular the hollow body, in order to form the extreme front portion of the device and first come into contact with an obstacle which is encountered during the forward movement.

The electric drive motor and the electric pumping motor may be of any known type. According to a preferred embodiment, these electric motors are low-voltage motors. They can be supplied with electrical power via an electrical power supply external to the device via an electrical cable which is not illustrated in the Figures and which is connected to the device in the region of a zone 19 for introducing the electrical cable into the device, as illustrated in FIG. 1.

Furthermore, according to a preferred embodiment of the invention, the device also comprises an operating handle 7 which allows a user to carry the device in order to immerse it in a liquid and to remove it therefrom. This handle 7 is preferably arranged opposite the liquid outlet 10 so that when the hollow body 1 is suspended via this handle, the device tilts spontaneously under the effect of gravity into a position in which the liquid outlet 10 is located below the liquid inlet 9 which allows the device to be emptied. When the device moves from the cleaning position to the emptying position, the debris drawn in by the device are retained in the filtering device and cannot be discharged from the device.

A device according to the invention, owing to the arrangement of the pumping motor below the hydraulic circuit, entirely at the outer side of the hydraulic circuit which entirely bypasses the pumping motor at the top, has minimized pressure losses. In particular, the hydraulic path is less complex than those imposed by the devices of the prior art. Consequently, a device according to the invention requires less energy than previous devices in order to provide the flow of liquid in the device and can therefore be provided with a motor which consumes less energy. It is found that a device according to the invention which has an overall height of 250 mm and which is provided with a pumping motor with a power of 80W can produce a flow of liquid in the order of 18 $m^3/h$. The total power consumed for the operation of this device driven at a mean speed in the order of 10 m/min is approximately 85W. In comparison, a device in accordance, for example, with WO 0250388 which is provided with the same pumping motor and which has the same height produces a flow in the order of 15 $m^3/h$. Furthermore, the total power consumed for the operation of this prior device driven at the same mean speed is in the order of 105 W. It is therefore found that a device in accordance with the invention shows an improvement in performance levels of approximately 20% with respect to a prior device comparable with WO 0250388.

Of course, the invention may involve numerous construction variants and applications.

For example, according to an embodiment which is not illustrated in the Figures, the filtering device 11 may have an upper wall which forms the upper wall of the housing of the device, so that a user can directly grip the filtering device 11 and remove it from the device.

Furthermore, the sizing and the configuration of the device, in particular the hydraulic circuit thereof, are subject to an infinite number of variants. In addition, the invention can be used for a bi-directional device which is capable of backward movement.

The invention claimed is:

1. A swimming pool cleaner comprising:

a. a body (i) having a longitudinal axis, (ii) comprising a water inlet, a water outlet, an internal wall, and an outer wall, and (iii) configured for movement in at least a forward direction of travel;

b. a filtering device positioned to a first side of the internal wall and between the water inlet and the water outlet so as to filter water flowing therethrough, at least a portion of the filtering device being above the internal wall when the body is upright;

c. a pumping motor assembly (i) positioned entirely rearward of the water inlet when the body is travelling in the forward direction and (ii) comprising (A) a motor located to a second side of the internal wall opposite the first side, the motor being below at least a portion of the internal wall when the body is upright and (B) a rotating drive shaft extending through the internal wall; and d. an axial propeller (i) coupled to the rotating drive shaft and (ii) having an axis of rotation inclined relative to the longitudinal axis at an angle other than zero or ninety degrees,

2. A swimming pool cleaner according to claim 1 further comprising a flap provided on the outer wall of the body and configured to be moveable so as to expose the filtering device and allow it to be removed from the body.

3. A swimming pool cleaner according to claim 1 in which the axis of rotation of the axial propeller is coaxial with the rotating drive shaft.

4. A swimming pool cleaner according to claim 1 in which the axis of rotation. of the axial propeller is inclined relative to the longitudinal axis at an angle of between 30-60°.

5. A swimming pool cleaner according to claim 2 in which the filtering device comprises a filtering cartridge.

6. A swimming pool cleaner according to claim 2 in which the axis of rotation of the axial propeller is coaxial with the rotating drive shaft.

7. A swimming pool cleaner according to claim 2 in which the axis of rotation of the axial propeller is inclined relative to the longitudinal axis at an angle of between 30-60°.

* * * * *